US009938890B2

(12) United States Patent
Kurata et al.

(10) Patent No.: US 9,938,890 B2
(45) Date of Patent: Apr. 10, 2018

(54) UNIFLOW TWO-STROKE ENGINE

(71) Applicant: HONDA MOTOR CO., LTD., Tokyo (JP)

(72) Inventors: Mashu Kurata, Tokyo (JP); Yoshikazu Yamada, Saitama (JP)

(73) Assignee: HONDA MOTOR CO., LTD., Tokyo (JP)

( * ) Notice: Subject to any disclaimer, the term of this patent is extended or adjusted under 35 U.S.C. 154(b) by 28 days.

(21) Appl. No.: 14/798,683

(22) Filed: Jul. 14, 2015

(65) Prior Publication Data

US 2016/0032816 A1 Feb. 4, 2016

(30) Foreign Application Priority Data

Aug. 1, 2014 (JP) ..... 2014-157496

(51) Int. Cl.
*F02B 25/02* (2006.01)
*F02F 7/00* (2006.01)
(Continued)

(52) U.S. Cl.
CPC ..... *F02B 25/02* (2013.01); *F02B 9/02* (2013.01); *F02F 1/22* (2013.01); *F02F 7/0036* (2013.01);
(Continued)

(58) Field of Classification Search
CPC ..... F02B 25/02; F02B 33/00; F02B 67/10; F02B 25/00; F02B 25/14; F02B 2720/236; F02D 41/0047; F02D 41/006
(Continued)

(56) References Cited

U.S. PATENT DOCUMENTS 5,224,460 A * 7/1993 Havstad ..... F01L 3/10 123/184.54
5,425,346 A * 6/1995 Mavinahally ..... F01L 7/12 123/568.13
(Continued)

FOREIGN PATENT DOCUMENTS

JP 49-97119 A 9/1974
JP 4-17718 A 1/1992
(Continued)

OTHER PUBLICATIONS

Office Action dated Aug. 8, 2017, issued in counterpart Japanese Application No. 2014-157496, with English translation. (12 pages).

*Primary Examiner* — Long T Tran
(74) *Attorney, Agent, or Firm* — Westerman, Hattori, Daniels & Adrian

(57) ABSTRACT

A uniflow two-stroke engine includes: a cylinder receiving a piston such that the piston can reciprocate therein and defining a combustion chamber above the piston; an exhaust port having one end in communication with an upper end portion of the cylinder; a scavenging port having a scavenging orifice at one end, the scavenging orifice being in communication with a lower part of a side portion of the cylinder such that the scavenging port is selectively brought into communication with and shut off from the combustion chamber by the piston; and an exhaust gas recirculation passage having one end in communication with a part of the side portion of the cylinder above the scavenging port and the other end in communication with the scavenging port such that the exhaust gas recirculation passage is selectively brought into communication with and shut off from the combustion chamber by the piston.

7 Claims, 5 Drawing Sheets

(51) Int. Cl.

| | |
|---|---|
| ***F02B 9/02*** | (2006.01) |
| ***F02F 1/22*** | (2006.01) |
| ***F02M 26/41*** | (2016.01) |
| *F02B 33/04* | (2006.01) |
| *F01M 11/02* | (2006.01) |

(52) U.S. Cl.
CPC ..... *F02M 26/41* (2016.02); *F01M 2011/022* (2013.01); *F02B 33/04* (2013.01)

(58) Field of Classification Search
USPC ..... 123/65 PE, 65 V, 65 VB, 65 VC, 65 VD, 123/65 P
See application file for complete search history.

(56) References Cited

U.S. PATENT DOCUMENTS 5,997,292 A * 12/1999 Tanaka ..... F23L 7/00 432/180
6,101,989 A * 8/2000 Green ..... F02B 23/0672 123/568.14
6,591,792 B2 * 7/2003 Nemoto ..... F02B 25/14 123/182.1
6,591,793 B2 * 7/2003 Nemoto ..... F02B 25/14 123/73 A
6,597,792 B1 * 7/2003 Sapiejewski ..... H04R 1/1083 381/371
6,892,682 B2 * 5/2005 Ludu ..... F02B 25/04 123/568.11
6,901,892 B2 * 6/2005 Mavinahally ..... F01L 7/12 123/73 V
7,066,119 B2 * 6/2006 Yasuda ..... F02B 33/04 123/65 P
8,150,597 B2 * 4/2012 Yamakawa ..... F02D 13/0215 123/316
2004/0040522 A1 * 3/2004 Mavinahally ..... F01L 7/12 123/73 V
2004/0103863 A1 * 6/2004 Ludu ..... F02B 25/04 123/65 VC
2009/0138174 A1 * 5/2009 Nishida ..... F02B 17/00 701/103
2009/0139485 A1 * 6/2009 Pontoppidan ..... F02B 23/104 123/305
2009/0183710 A1 * 7/2009 Philberth ..... F01L 1/38 123/268
2010/0170485 A1 7/2010 Bram
2013/0239933 A1 * 9/2013 Yasuda ..... F02B 75/02 123/65 R
2013/0312704 A1 * 11/2013 Taylor ..... F02B 75/24 123/44 C

FOREIGN PATENT DOCUMENTS

JP 410-77845 A 3/1998
JP 2005-201075 A 7/2005
JP 5039790 B2 10/2012

* cited by examiner

UNIFLOW TWO-STROKE ENGINE

TECHNICAL FIELD

The present invention relates to a uniflow two-stroke engine.

BACKGROUND OF THE INVENTION

A uniflow two-stroke engine that includes an exhaust port provided in an upper end part of the cylinder and a scavenging port provided in a lower side portion of the cylinder is known. The scavenging port is opened and closed by a side portion of the piston reciprocating in the cylinder. In this engine, combustion occurs when the piston is in the vicinity of the top dead center, and as the piston moves downward, the exhaust valve is opened and the expanded combustion gas (exhaust gas) is discharged through the exhaust port. At this time, in a typical two-stroke engine, the downward movement of the piston compresses the air-fuel mixture in the crank chamber while opening the scavenging port, so that the air-fuel mixture in the crank chamber flows into the cylinder via the scavenging port. Thereby, the combustion gas in the cylinder is pushed out through the exhaust port by the entering air-fuel mixture. At this time, if the layer of air-fuel mixture flowing into the cylinder and the layer of the combustion gas are not mixed with each other and a clear boundary therebetween is maintained, it is possible to discharge only the combustion gas via the exhaust port. However, part of the air-fuel mixture is mixed with the combustion gas or has a velocity higher than that of the combustion gas, so that the part of the air-fuel mixture is discharged through the exhaust port to the outside together with the combustion gas, which phenomenon is known as "blow-by." The blow-by of the air-fuel mixture is not favorable in view of fuel consumption and environmental pollution.

To address such a problem, there is an engine having an air-fuel mixture separator disposed on a path passing the scavenging port (see JP5039790B, for example). In this engine, the air-fuel mixture is caused to pass through a centrifugal-type separator and separated into a fuel-rich air-fuel mixture and a fuel-lean air-fuel mixture, which are supplied to the cylinder via different passages. Thus, by using the fuel-lean air-fuel mixture to perform the scavenging, it is possible to decrease the concentration of fuel discharged through the exhaust port.

With regard to the uniflow two-stroke engines, in addition to the demand for suppression of the aforementioned blow-by, there is a demand for use of a compression ignition system to improve thermal efficiency. To perform stable compression ignition, it is necessary to maintain a high temperature of the air-fuel mixture supplied to the cylinder. With regard to the scavenging, it is preferred to discharge the combustion gas in the cylinder as much as possible from the point of view of volumetric efficiency (intake efficiency), but this would waste the energy of the combustion gas (exhaust gas), so that the temperature of the cylinder and the air-fuel mixture flowing into the cylinder is lowered, leading to unstable compression ignition.

SUMMARY OF THE INVENTION

In view of the aforementioned background, an object of the present invention is to improve warm-up performance of a uniflow two-stroke engine.

Means to Accomplish the Task

To achieve the above object, the present invention provides a uniflow two-stroke engine (E), comprising: a cylinder (22) receiving a piston (23) such that the piston can reciprocate therein and defining a combustion chamber (29) above the piston; an exhaust port (31) having one end in communication with an upper end portion of the cylinder; an exhaust valve (32) that opens and closes the exhaust port; a scavenging port (55) having a scavenging orifice (56) at one end, the scavenging orifice being in communication with a lower part of a side portion of the cylinder such that the scavenging port is selectively brought into communication with and shut off from the combustion chamber by the piston; and an exhaust gas recirculation passage (58) having one end in communication with a part of the side portion of the cylinder above the scavenging orifice and the other end in communication with the scavenging port such that the exhaust gas recirculation passage is selectively brought into communication with and shut off from the combustion chamber by the piston.

According to this structure, when the piston moves downward following the combustion, the exhaust gas recirculation passage is opened by the piston before the scavenging port is opened by the piston, such that the combustion gas (exhaust gas) in the combustion chamber flows to the scavenging port through the exhaust gas recirculation passage. Consequently, the heat possessed by the combustion gas that flows into the scavenging port via the exhaust gas recirculation passage causes the temperature of the crankcase to rise, thereby promoting warm-up. Further, the combustion gas promotes heating of the air-fuel mixture in the scavenging port and evaporation of the fuel. Therefore, the engine of the present invention is suitable for the compression ignition combustion system. Further, when the scavenging port is opened by the piston, there is much combustion gas in the scavenging port, and this combustion gas readily flows into the combustion chamber. Consequently, a layer of the combustion gas that had flown into the scavenging port via the exhaust gas recirculation passage is created between the combustion gas in the combustion chamber and the air-fuel mixture flowing into the combustion chamber, whereby mixing of the air-fuel mixture flowing into the combustion chamber and the combustion gas in the combustion chamber is suppressed and the blow-by of the air-fuel mixture is suppressed.

In the aforementioned invention, preferably, the uniflow two-stroke engine further includes a one-way valve (59) provided to the exhaust gas recirculation passage and permitting a flow of gas from the combustion chamber toward the scavenging port via the exhaust gas recirculation passage while preventing a flow of gas in the opposite direction.

According to this structure, flow of the gas into the combustion chamber from the scavenging port through the exhaust gas recirculation passage is suppressed. Consequently, the gas containing the air-fuel mixture flows into the combustion chamber only from the scavenging port, whereby the flow becomes constant and mixing of the air-fuel mixture flowing into the combustion chamber and the combustion gas in the combustion chamber is suppressed. Thereby, the blow-by of the air-fuel mixture is suppressed.

Further, in the aforementioned invention, the one-way valve is preferably configured to open only when a pressure on a side of the combustion chamber becomes greater than a pressure on a side of the scavenging port by a predetermined value or more. The one-way valve is preferably configured to close when the exhaust port and the scavenging port are opened during a downward stroke of the piston.

According to these structures, when the combustion gas undergoes expansion following the combustion in the combustion chamber, the combustion gas flows into the scavenging port from the combustion chamber through the exhaust gas recirculation passage, and when the scavenging port is opened, the flow of the gas via the exhaust gas recirculation passage is shut off.

Further, in the aforementioned invention, the one-way valve preferably consists of a reed valve mounted to an outer circumferential surface of a cylinder sleeve forming the cylinder.

According to this structure, it is possible to provide the exhaust gas recirculation passage with a one-way valve with a simple structure. The opening timing of the reed valve (the difference in pressure between the combustion chamber side and the scavenging port side of the reed valve at which the reed valve opens) can be arbitrarily adjusted by changing the modulus of elasticity of the valve body (plate-like piece).

Further, in the aforementioned invention, preferably, the exhaust valve is configured to open before the exhaust gas recirculation passage and the combustion chamber are brought into communication during a downward stroke of the piston.

According to this structure, an amount of the combustion gas flowing to the scavenging port through the exhaust gas recirculation passage is suppressed. If a discharge passage for the combustion gas is opened during the expansion stroke (downward stroke of the piston), the combustion gas which has high energy flows swiftly to the discharge passage (known as a blowdown flow of the exhaust gas (combustion gas)). Therefore, upon opening of the exhaust port before the exhaust gas recirculation passage is opened, a part of the combustion gas is released through the exhaust port and the amount of the combustion gas flowing to the exhaust gas recirculation passage is suppressed.

Further, in the aforementioned invention, preferably, the exhaust gas recirculation passage is in communication with a downstream portion (57) of the scavenging port.

According to this structure, the combustion gas fills the scavenging port from the downstream portion thereof, pushing out the air-fuel mixture toward the crank chamber, such that a layer of the combustion gas is created in the downstream portion of the scavenging port. Owing to the layer of the combustion gas created in the scavenging port, mixing of the air-fuel mixture flowing into the combustion chamber and the combustion gas in the combustion chamber is suppressed and the blow-by of the air-fuel mixture is suppressed.

Further, in the aforementioned invention, preferably, the scavenging port has an upstream end in communication with a crank chamber (2A) defined below the cylinder and includes an upstream portion (57A) extending from the crank chamber upward along an axis of the cylinder and a downstream portion (57B) extending from an upper end part of the upstream portion circumferentially along an outer surface of the cylinder, the exhaust gas recirculation passage being in communication with the downstream portion.

According to this structure, since the downstream portion of the scavenging port extends in the circumferential direction, the gas flowing into the combustion chamber through the scavenging port forms a swirl, whereby mixing of the gas with the combustion gas in the combustion chamber is suppressed.

Further, in the aforementioned invention, preferably, the downstream portion of the scavenging port is configured to include a portion that slopes downward toward a downstream side such that a flow of gas flowing into the cylinder from the scavenging port flows in a direction away from the exhaust port.

According to this structure, the flow of gas flowing into the cylinder from the scavenging port flows in a direction away from the exhaust port at an initial stage at which the flow of gas has a high velocity, and impinges upon the top of the piston and the inner wall of the cylinder, whereby the velocity is reduced. Thereafter, the flow of gas changes its direction to flow toward the exhaust port. Thereby, mixing of the flow of gas flowing into the cylinder from the scavenging port and the combustion gas in the cylinder is suppressed, and the flow of gas from the scavenging port is restrained from reaching the exhaust port earlier than the combustion gas. This ensures a clear boundary between the layer of the combustion gas and the layer of the gas supplied from the scavenging port inside the cylinder, and makes it possible to discharge the combustion gas more reliably while restraining the gas supplied from the scavenging port from flowing out through the exhaust port more reliably.

Further, in the aforementioned invention, preferably, combustion is initiated by compression ignition.

According to this structure, the thermal efficiency of the engine is improved.

According to the foregoing structure, it is possible to improve the warm-up performance of a uniflow two-stroke engine.

DETAILED DESCRIPTION OF THE PREFERRED EMBODIMENTS

In the following, a detailed description will be made of an embodiment of the present invention with reference to the drawings, in which the present invention is applied to a single cylinder, uniflow two-stroke engine (hereinafter referred to as an engine E). The engine E in this embodiment is configured as an HCCI engine in which ignition is caused by compression. The engine E uses light oil or gasoline as fuel.

Figure 1:
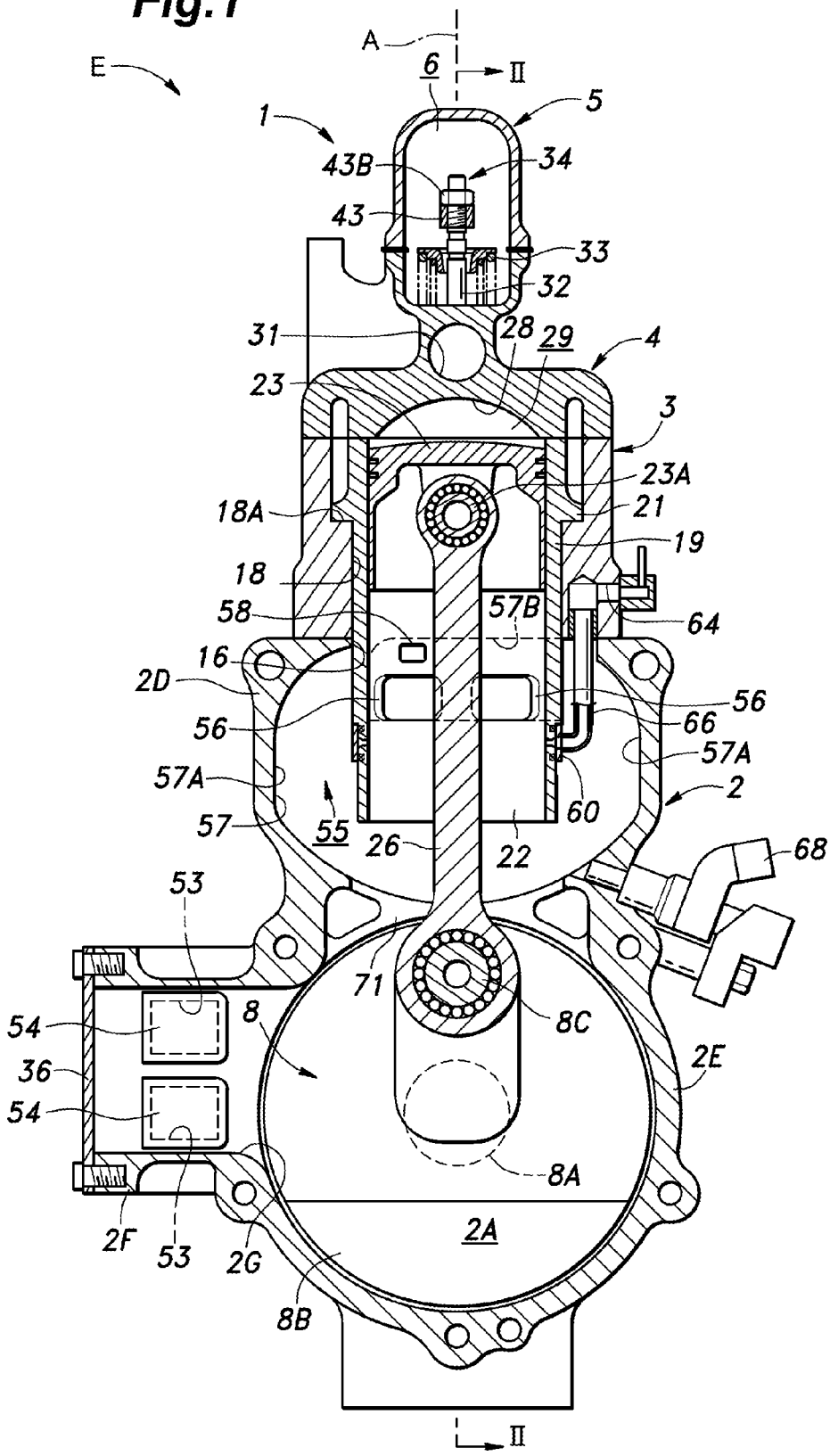
FIG. 1 is a vertical cross-sectional view of an engine relating to an embodiment of the present invention.
Figure 2:
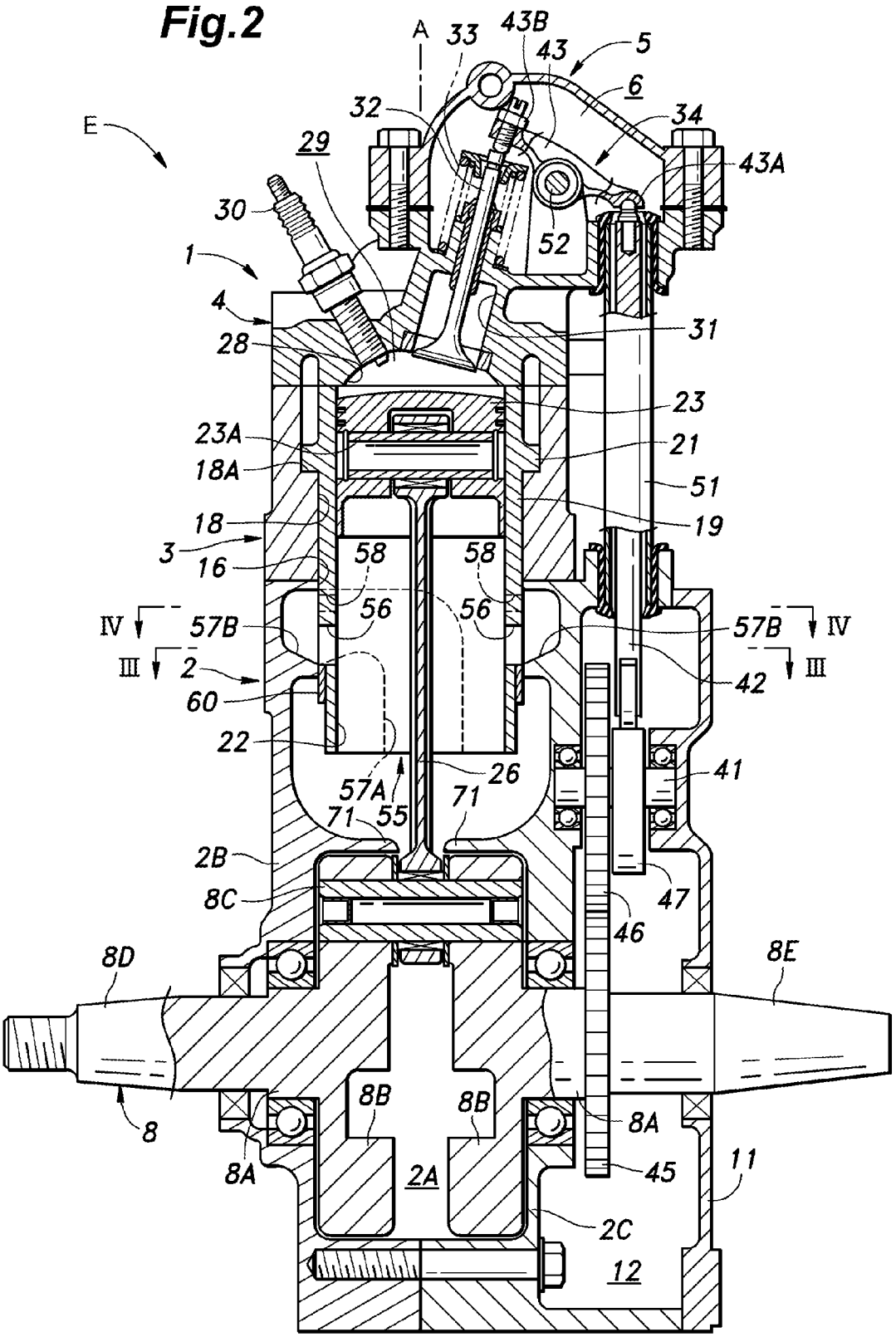
FIG. 2 is a cross-sectional view taken along line II-II in FIG. 1.

As shown in FIG. 1 and FIG. 2, an engine main body 1 of the engine E includes a crankcase 2 defining a crank chamber 2A therein, a cylinder block 3 attached to an upper part of the crankcase 2, a cylinder head 4 attached to an upper part of the cylinder block 3, and a head cover 5 attached to an upper part of the cylinder head 4 and defining an upper valve chamber 6 between itself and the cylinder head 4.

As shown in FIG. 2, the crankcase 2 is constituted of a pair of crankcase halves which are parted laterally by a vertically extending surface (a surface passing the cylinder axis A). The left and right crankcase halves are fastened to each other by bolts and define the crank chamber 2A therebetween. The left and right side walls 2B, 2C of the crankcase 2 rotatably support a crankshaft 8 via bearings.

The crankshaft 8 includes a pair of journals 8A supported by the side walls 2B, 2C of the crankcase 2, a pair of crank webs 8B provided between the journals 8A, and a crankpin 8C supported by the crank webs 8B at a position radially offset from the journals 8A.

An end plate 11 is secured on an outer surface side of the right side wall 2C. The end plate 11 is secured to the outer surface of the right side wall 2C at a periphery thereof and defines a lower valve chamber 12 between itself and the right side wall 2C. The left end portion 8D of the crankshaft 8 passes through the left side wall 2B of the crankcase 2 and extends out to the left. The right end portion 8E of the crankshaft 8 passes through the right side wall 2C of the crankcase 2 and the end plate 11 and extends out to the right. A seal member is provided at each of the part where the left end portion 8D of the crankshaft 8 passes through the left side wall 2B and the part where the right end portion 8E of the same passes through the end plate 11 to ensure an air tight seal of the crank chamber 2A.

The upper part of the crankcase 2 has a first sleeve reception bore 16 formed therein, where the first sleeve reception bore 16 extends vertically, has an upper end that opens out at the upper end surface of the crankcase 2 and a lower end that opens out to the crank chamber 2A, and has a circular cross section.

The cylinder block 3 extends vertically and is fastened to the upper end surface of the crankcase 2 at the lower end surface thereof. The cylinder block 3 is provided with a second sleeve reception bore 18 that extends vertically therethrough from the upper end surface to the lower end surface. The second sleeve reception bore 18 is a stepped bore having a circular cross section, where an upper part of the second sleeve reception bore 18 is given a larger diameter than a lower part such that an upward-facing annular shoulder surface 18A is defined at the interface between the upper part and the lower part. The lower end opening of the second sleeve reception bore 18 is aligned coaxially with the upper end opening of the first sleeve reception bore 16 of the cylinder block 3 and is connected with the same. The first sleeve reception bore 16 and the lower part of the second sleeve reception bore 18 have the same inner diameter so as to form a continuous bore.

Press-fitted into the first and second sleeve reception bores 16, 18 is a cylinder sleeve 19 having a cylindrical shape. The cylinder sleeve 19 is provided on its outer circumference with an annular projection 21 that projects radially outward. The projection 21 abuts the shoulder surface 18A to determine the position of the cylinder sleeve 19 relative to the first and second sleeve reception bores 16, 18. The lower end of the cylinder sleeve 19 protrudes downward from the lower end opening of the first sleeve reception bore 16 and makes a protruding end inside the crank chamber 2A. The upper end of the cylinder sleeve 19 is positioned so as to be flush with the upper end surface of the cylinder block 3 and abuts the lower end surface of the cylinder head 4 joined to the cylinder block 3. Thereby, the cylinder sleeve 19 is interposed between the shoulder surface 18A and the lower surface of the cylinder head 4, and the position thereof in the direction of the cylinder axis A is determined. The inner bore of the cylinder sleeve 19 forms a cylinder 22.

The cylinder 22 receives a piston 23 such that the piston 23 can reciprocate therein. The piston 23 has a piston pin 23A extending in parallel with the crankshaft 8. The piston pin 23A pivotably supports the small end of a connecting rod 26 via a bearing. The large end of the connecting rod 26 is pivotably supported by the crankpin 8C via a bearing. As the piston 23 and the crankshaft 8 are connected by the connecting rod 26, the reciprocating movement of the piston 23 is converted to the rotational movement of the crankshaft 8.

As shown in FIG. 1 and FIG. 2, a hemispherical combustion chamber recess 28 is formed at a part of the lower end surface of the cylinder head 4 corresponding to the cylinder sleeve 19. In cooperation with the combustion chamber recess 28 and the top surface of the piston 23, an upper part of the cylinder 22 defines a combustion chamber 29.

The cylinder head 4 is provided with a spark plug 30 so as to face the combustion chamber 29. Further, the cylinder head 4 is provided with an exhaust port 31 opening out at the top end of the combustion chamber 29 and an exhaust valve 32 consisting of a poppet valve to selectively close and open the exhaust port 31. The exhaust valve 32 has a stem end disposed in the upper valve chamber 6 and is urged by a valve spring 33 in the closing direction. The exhaust valve 32 is opened and closed by a valve actuating mechanism 34 in synchronization with the rotation of the crankshaft 8.

As shown in FIG. 2, the valve actuating mechanism 34 includes a camshaft 41 that rotates in response to the rotation of the crankshaft 8, a pushrod 42 driven to advance and retreat by the camshaft 41, and a rocker arm 43 driven by the pushrod 42 to push the exhaust valve 32 in the opening direction. The camshaft 41 is disposed in the lower valve chamber 12 in parallel with the crankshaft 8. The camshaft 41 has one end rotatably supported by the right side wall 2C of the crankcase 2 and the other end rotatably supported by the end plate 11. The crankshaft 8 has a crank gear 45 at a part located in the lower valve chamber 12, and the camshaft 41 has a cam gear 46 engaging the crank gear 45. The gear ratio between the crank gear 45 and the cam gear 46 is 1:1. The camshaft 41 is provided with a cam 47 consisting of a plate cam.

The pushrod 42 is received in a tubular rod case 51 having open ends so as to be capable of advancing and retreating. The rod case 51 extends vertically, and the lower end thereof is joined to the right side wall 2C of the crankcase 2 and in communication with the lower valve chamber 12 while the upper end thereof is joined to the cylinder block 3 and in communication with the upper valve chamber 6. The pushrod 42 is in contact with the cam 47 of the camshaft 41 at its lower end, and advances and retreats in response to the rotation of the camshaft 41. It is also possible to provide the lower end of the pushrod 42 with a roller, so that the pushrod 42 is in rolling contact with the cam 47 via the roller.

The rocker arm 43 is pivotably supported by a rocker shaft 52 supported by the cylinder head 4. The rocker shaft 52 extends in a direction perpendicular to the cylinder axis A and the axis of the crankshaft 8. The rocker arm 43 has at one end thereof a receiving part 43A in contact with the upper end of the pushrod 42 and has at the other end thereof a screw adjuster 43B in contact with the stem end of the exhaust valve 32.

With the valve actuating mechanism 34 having the foregoing structure, each time the crankshaft 8 makes one revolution, the exhaust valve 32 is opened once at a predetermined timing.

As shown in FIG. 1, the front side wall 2D of the crankcase 2 is provided with a protruding portion 2F that protrudes forward. The interior of the protruding portion 2F defines a passage 2G extending in a fore and aft direction and having a rear end connected with the crank chamber 2A and an open front end. The front end of the passage 2G is closed by a lid 36 fastened to the front end of the protruding portion 2F. The left wall portion of the protruding portion 2F is provided with intake ports 53, which are through-holes connecting the inside and the outside of the protruding portion 2F. An outer end of each intake port 53 is connected with an intake passage not shown in the drawings. Each intake port 53 is provided with a reed valve 54 that permits the flow of fluid from the intake port 53 toward the crank chamber 2A while prohibiting the flow of fluid from the crank chamber 2A toward the intake port 53. The reed valve 54 is normally closed, and opens when the piston 23 moves upward and the internal pressure in the crank chamber 2A thereby drops.

The crankcase 2 and the cylinder sleeve 19 are provided with scavenging ports 55 that connect the crank chamber 2A with an interior of the cylinder sleeve 19. Each scavenging port 55 includes a scavenging orifice 56 formed in the cylinder sleeve 19 and a passage portion 57 extending from scavenging orifice 56 to the crank chamber 2A. The passage portion 57 is defined in an upper part of the crankcase 2 around the first sleeve reception bore 16. In the present embodiment, each scavenging port 55 has two scavenging orifices 56 and one passage portion 57. The scavenging orifices 56 are formed in a part of the cylinder sleeve 19 inside the first sleeve reception bore 16 so as to extend through the cylinder sleeve 19 in the radial direction. The vertical dimension of the scavenging orifices 56 is selected to be smaller than the vertical dimension of the outer circumferential surface of the piston 23.

The scavenging orifices 56 (scavenging ports 55) are opened and closed by the reciprocating movement of the piston 23. Specifically, when the piston 23 is at a position corresponding to the scavenging orifices 56, the scavenging ports 55 are closed by the outer circumference of the piston 23, when the lower edge of the piston 23 is located higher than the lower edge of the scavenging orifices 56 (on the side of the top dead center), the scavenging ports 55 are opened so as to be in communication with the part of the cylinder 22 below the piston 23, and when the upper edge of the piston 23 is located lower than the upper edge of the scavenging orifices 56 (on the side of the bottom dead center), the scavenging ports 55 are opened so as to be in communication with the part of the cylinder 22 above the piston 23.

Figure 3:
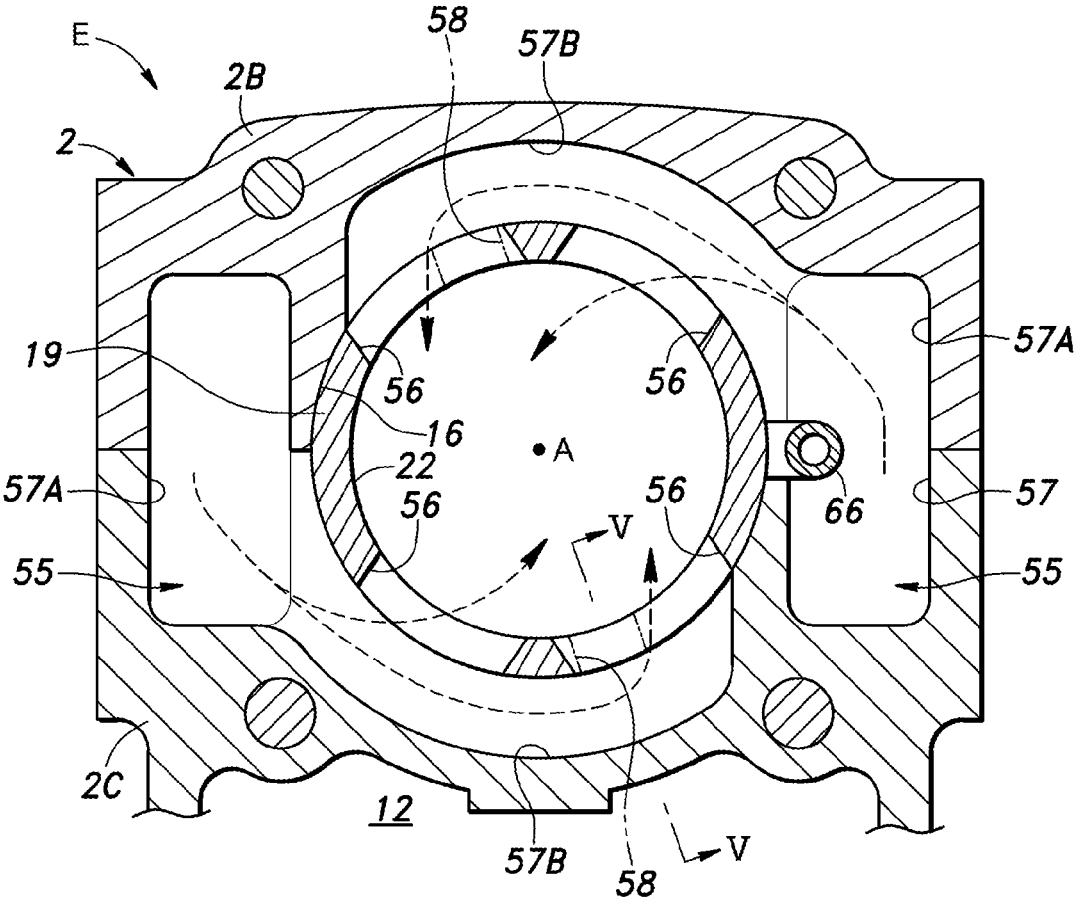
FIG. 3 is a cross-sectional view taken along line III-III in FIG. 2.

As shown in FIG. 1 to FIG. 3, in the present embodiment, the engine E has a pair of scavenging ports 55. The pair of scavenging ports 55 and the scavenging orifices 56 have a rotationally symmetric shape about the cylinder axis A and are disposed at 180 degrees rotationally symmetric positions.

The upstream portion 57A of each scavenging port 55 extends upward from a lower end connected with the crank chamber 2A in parallel with the cylinder axis A on an radially outer side of the cylinder sleeve 19. The upper end of the upstream portion 57A is positioned to be higher than the upper edge of the scavenging orifices 56.

As shown in FIG. 3, the downstream portion 57B extends from an upper portion of the upstream portion 57A to the scavenging orifices 56 in the circumferential direction on the radially outer side of the cylinder sleeve 19. As viewed from above along the cylinder axis A, the downstream portion 57B extends counterclockwise around the cylinder axis A from the upstream side to the downstream side. The downstream end of the downstream portion 57B is in communication with two scavenging orifices 56.

The downstream portion 57B is preferably configured to slope downward from the upstream side to the downstream side in the circumferential direction around the cylinder axis A. Further, as shown in FIG. 5, the downstream portion 57B is preferably configured to slope downward from the upstream side (radially outer side) to the downstream side (radially inner side) in the radial direction with the cylinder axis A being the center. The downstream portion 57B functions as a guide means that gives a downward velocity component to the gas flow entering the cylinder 22 from the scavenging port 55.

Figure 4:
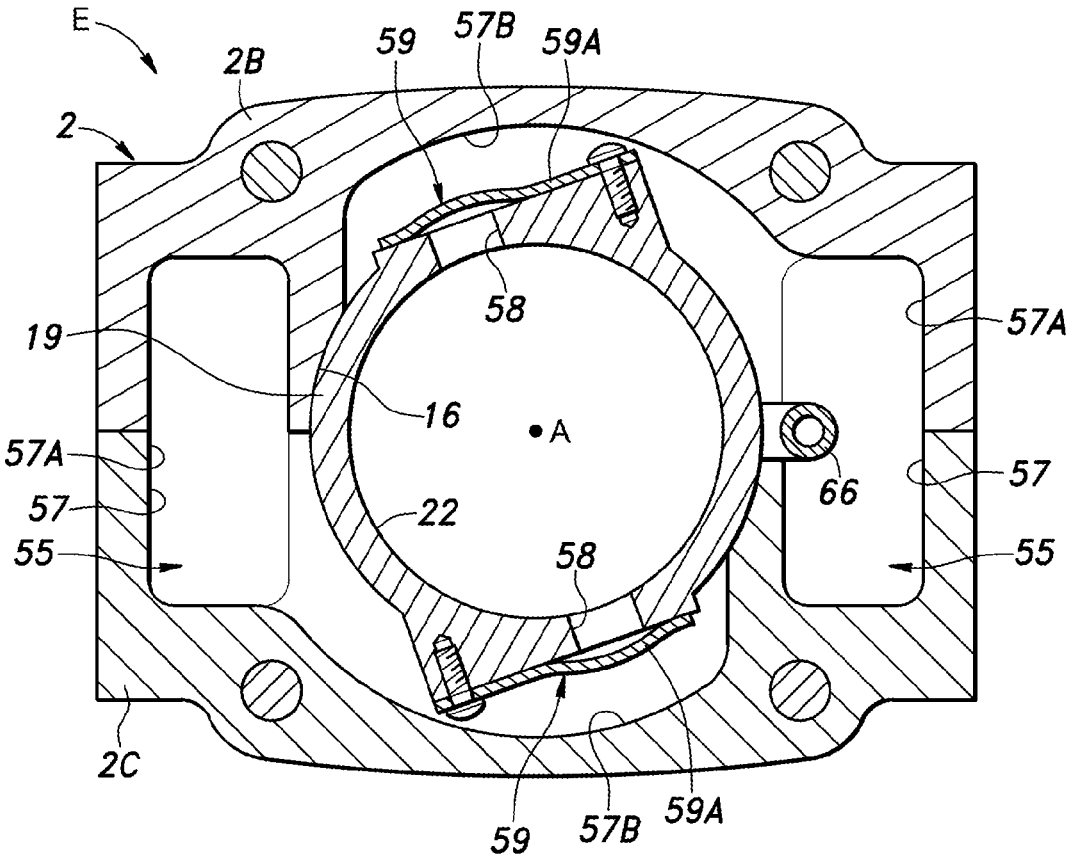
FIG. 4 is a cross-sectional view taken along line IV-IV in FIG. 2.

As shown in FIG. 1 and FIG. 4, the cylinder sleeve 19 is provided with exhaust gas recirculation passages 58 that connect the scavenging ports 55 with the inside of the cylinder sleeve 19. A pair of exhaust gas recirculation passages 58 are provided to correspond to the respective scavenging ports 55. The exhaust gas recirculation passages 58 are formed in a part of the cylinder sleeve 19 corresponding to the downstream portions 57B of the scavenging ports 55 and positioned higher than the scavenging orifices 56, such that exhaust gas recirculation passages 58 extend through the cylinder sleeve 19 in the radial direction. Specifically, the lower edge of the exhaust gas recirculation passages 58 is positioned higher than the upper edge of the scavenging orifices 56. The vertical dimension of the open end of each exhaust gas recirculation passage 58 on the inner circumferential surface of the cylinder 22 is selected to be smaller than the vertical dimension of the scavenging orifice 56.

It is preferred that each exhaust gas recirculation passage 58 is connected with a part of the corresponding scavenging port 55 located as downstream as possible. In the present embodiment, each exhaust gas recirculation passage 58 is provided above a downstream one of the two scavenging orifices 56 of the corresponding scavenging port 55.

The exhaust gas recirculation passages 58 are opened and closed by the reciprocating movement of the piston 23. Specifically, when the piston 23 is at a position corresponding to the exhaust gas recirculation passages 58, the exhaust gas recirculation passages 58 are closed by the outer circumference of the piston 23, when the lower edge of the piston 23 is located higher than the lower edge of the exhaust gas recirculation passages 58 (on the side of the top dead center), the exhaust gas recirculation passages 58 are opened so as to be in communication with the part of the cylinder 22 below the piston 23, and when the upper edge of the piston 23 is located lower than the upper edge of the exhaust gas recirculation passages 58 (on the side of the bottom dead center), the exhaust gas recirculation passages 58 are opened so as to be in communication with the part of the cylinder 22 above the piston 23 (the combustion chamber 29) (see FIGS. 5 (A) and (B)).

As shown in FIG. 4, each exhaust gas recirculation passage 58 is provided with a one-way valve 59 that permits the flow of gas from the combustion chamber 29 toward the scavenging ports 55 while prohibiting the flow of gas in the opposite direction (from the scavenging ports 55 toward the combustion chamber 29). The one-way valve 59 is preferably urged in the closing direction such that it opens when the pressure on the side of the combustion chamber 29 becomes greater than the pressure on the side of the scavenging port 55 by a predetermined value or more. In the present embodiment, the one-way valve 59 consists of a reed valve 59 disposed in the downstream portion 57B of the corresponding scavenging port 55 and fastened to the outer circumferential surface of the cylinder sleeve 19. The reed valve 59 includes a flexible plate-like piece 59A made of a metallic material, for example. The plate-like piece 59A has a base end portion fastened to the outer circumferential surface of the cylinder sleeve 19 by means of a screw or the like and a tip end portion for closing the open end of the exhaust gas recirculation passage 58 on the side of the scavenging port 55. The plate-like piece 59A is urged by its own elastic force toward the open end of the exhaust gas recirculation passage 58 on the side of the scavenging port 55, and is in close contact with the outer circumferential surface of the cylinder sleeve 19 when the difference between the pressure inside the cylinder sleeve 19 and the pressure in the scavenging port 55 is lower than a predetermined value. When the piston 23 moves downward to open the exhaust gas recirculation passage 58 and the pressure inside the cylinder sleeve 19 becomes greater than the pressure in the scavenging port 55 by the predetermined value or more, the plate-like piece 59A receives a pressure and bends to bring the exhaust gas recirculation passage 58 and the downstream portion 57B of the scavenging port 55 in communication with each other.

As shown in FIG. 1, an annular oil passage forming member 60 is attached to the outer circumference of the lower end part of the cylinder sleeve 19 projecting into the crank chamber 2A. The inner circumference of the oil passage forming member 60 is in surface contact with the outer circumference of the cylinder sleeve 19 in the circumferential direction. The part of the outer circumference of the cylinder sleeve 19 facing the inner circumference of the oil passage forming member 60 is formed with an annular groove that extends annularly in the circumferential direction (reference number is omitted). The annular groove is covered by the oil passage forming member 60 to define an annular channel. The oil passage forming member 60 is provided with an oil inlet hole (reference number is omitted) radially extending therethrough and in communication with the annular groove. The cylinder sleeve 19 is provided with an oil supply hole (reference number is omitted) radially extending therethrough and in communication with the annular groove. Multiple oil supply holes are formed in the circumferential direction of the cylinder sleeve 19.

The cylinder block 3 has a first oil passage 64 formed therein. The first oil passage 64 has one end that opens out at the side surface of the cylinder block 3 and the other end that opens out at the lower end surface of the cylinder block 3. Connected to the open end of the first oil passage 64 that opens out at the lower end surface of the cylinder block 3 is one end of a second oil passage tube 66 that defines a second oil passage. The second oil passage tube 66 extends vertically in one scavenging port 55, and the other end thereof is connected to the oil inlet hole of the oil passage forming member 60. Thereby, the oil press-fed by the oil pump not shown in the drawings passes through the first oil passage 64, the second oil passage tube 66, the oil inlet hole, the annular groove and the oil supply holes in order, and is supplied to the inner wall of the cylinder sleeve 19.

As shown in FIG. 2, on the inner surfaces of the left and right side walls 2B, 2C of the crankcase 2 are provided respective flange portions 71 protruding toward each other. The flange portions 71 are located higher than the upper end of the crank webs 8B when the piston 23 is positioned at the top dead center, so that the flange portions 71 do not interfere with the crankshaft 8. Further, the pair of flange portions 71 is arranged so that a predetermined gap is defined between the tip ends of the flange portions 71 in the left and right direction, whereby they do not interfere with the connecting rod 26.

As shown in FIG. 1, a fuel injection valve 68 is mounted to a part of the rear side wall 2E of the crankcase 2 that is higher than the flange portions 71. The tip end of the fuel injection valve 68 is directed toward the lower end of the cylinder sleeve 19. The fuel injection valve 68 injects fuel into the crank chamber 2A at a predetermined timing.

The engine E having the structure described above operates as follows after start-up. With reference to FIG. 1, first, during the upward stroke of the piston 23, the pressure in the crank chamber 2A is lowered due to an expansion of the crank chamber 2A caused along with the upward movement of the piston 23. This causes the reed valves 54 to open, and fresh air flows into the crank chamber 2A via the intake ports 53. Fuel is injected by the fuel injection valve 68 toward the fresh air that has flowed into the crank chamber 2A, whereby an air-fuel mixture is generated. It is to be noted that at the start-up of the engine E, fuel is combusted by the spark ignition performed by the spark plug 30. At the same time, the air-fuel mixture in the upper part (the combustion chamber 29) of the cylinder 22 is compressed by the piston 23 such that the temperature thereof becomes high and the air-fuel mixture self-ignites (compression ignition) when the piston 23 is near the top dead center.

Figure 5A:
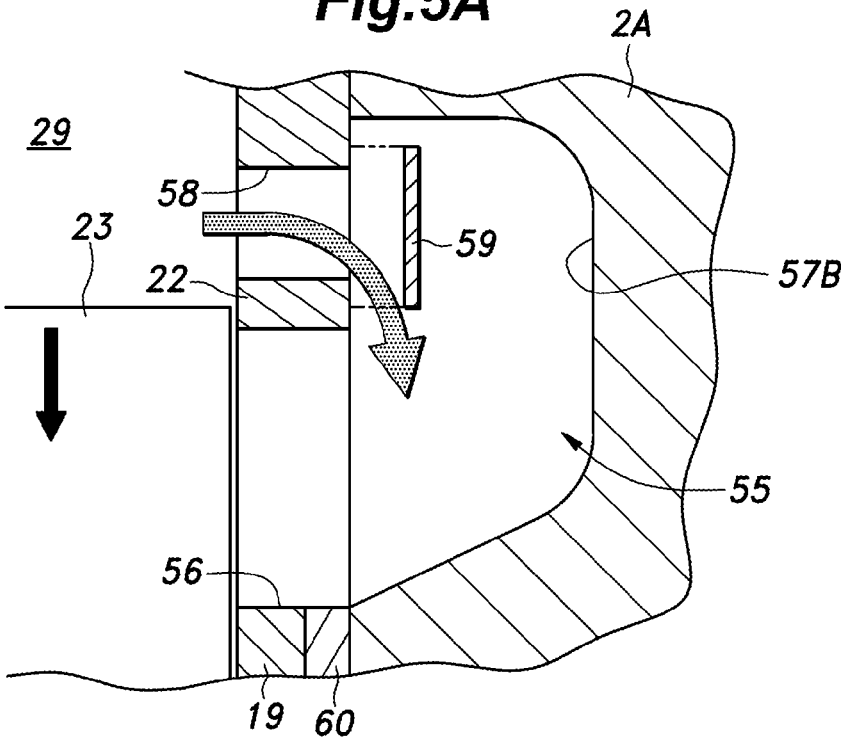
FIGS. 5A and 5B are explanatory diagrams each corresponding to a cross-sectional view taken along line V-V in FIG. 3 and showing a flow of gas during a downward stroke of the piston.

Thereafter, when the piston 23 starts its downward stroke, the pressure in the crank chamber 2A increases due to a contraction of the crank chamber 2A caused along with the downward movement of the piston 23. This causes the reed valves 54 to close, whereby the air-fuel mixture in the crank chamber 2A is compressed. As the piston 23 moves downward, the exhaust valve 32 driven by the valve actuating mechanism 34 opens the exhaust port 31. Thereby, the expanded exhaust gas (combustion gas) in the combustion chamber 29 flows through the exhaust port 31 as a blowdown flow. Subsequently, when the upper end edge of the piston 23 comes lower than the upper edge of the exhaust gas recirculation passages 58 (namely, when the piston 23 opens the exhaust gas recirculation passages 58), the combustion chamber 29 is brought into communication with the exhaust gas recirculation passages 58. At this time, the pressure of the combustion gas in the cylinder 22 is still high and is higher than the pressure in the crank chamber 2A. Therefore, as shown in FIG. 5(A), the difference between the pressure in the exhaust gas recirculation passage 58 and the pressure in the respective scavenging ports 55 becomes equal to or greater than the predetermined value so that the one-way valve 59 opens, and the combustion gas flows from the combustion chamber 29 to the downstream portion 57B of the scavenging port 55 via the exhaust gas recirculation passages 58 (shaded arrow in the drawing). Thereby, the downstream portion 57B is filled with the combustion gas. Thereafter, as the piston 23 further moves downward, the pressure of the combustion gas in the cylinder 22 decreases, and the difference between it and the pressure in the crank chamber 2A becomes less than the predetermined value, whereby the one-way valve 59 is closed.

Figure 5B:
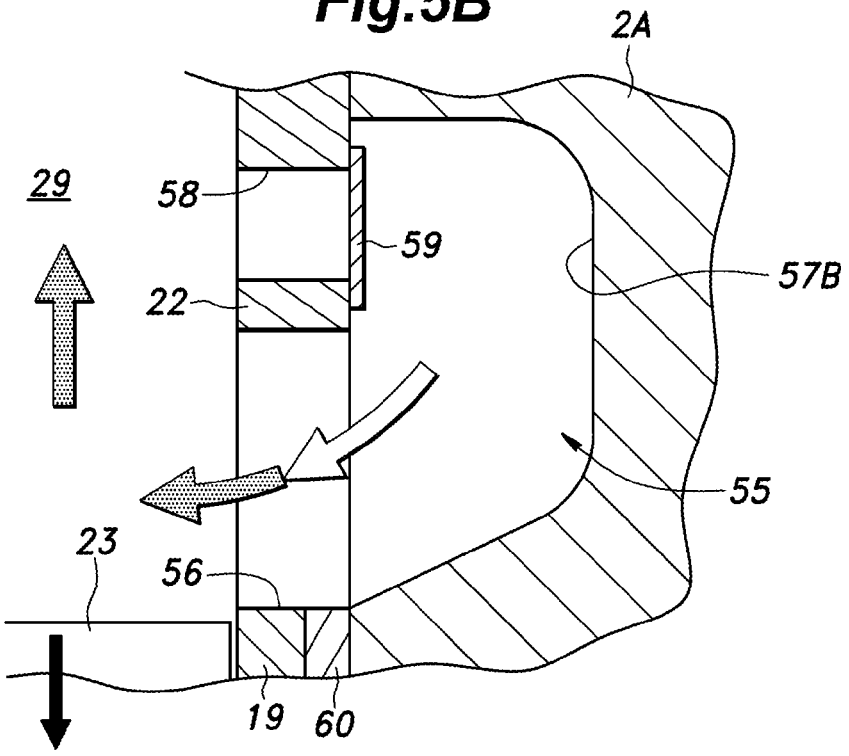

Thereafter, as the piston 23 further moves downward, when the upper end edge of the piston 23 comes lower than the upper edge of the scavenging orifices 56 (namely, when the piston 23 opens the scavenging ports 55), the combustion chamber 29 is brought into communication with the scavenging ports 55. At this time, the pressure of the combustion gas in the combustion chamber 29 has decreased sufficiently to be lower than the pressure in the crank chamber 2A. Therefore, as shown in FIG. 5(B), the gas flows from each scavenging port 55 to the combustion chamber 29. At this time, because the downstream portion 57B is filled with the combustion gas flowing in through the exhaust gas recirculation passage 58, the combustion gas in the downstream portion 57B of the scavenging port 55 flow into the cylinder 22 first (shaded arrow in the drawing), and subsequently, the air-fuel mixture from the crank chamber 2A flows into the cylinder 22 (white arrow in the drawing). Thereby, the combustion gas in the combustion chamber 29 is discharged through the exhaust port 31 by being pushed out by the combustion gas and air-fuel mixture present in the downstream portion 57B, and a part thereof remains in the combustion chamber 29 as an internal EGR gas.

When the piston 23 undergoes the upward stroke again, the scavenging ports 55 are closed by the piston 23 first, and then, the exhaust gas recirculation passages 58 are closed by the piston 23. During the upward stroke of the piston 23, the exhaust port 31 is kept open before the exhaust gas recirculation passages 58 are closed, such that the pressure in the combustion chamber 29 does not become greater than the pressure in the scavenging ports 55 by the predetermined value. Therefore, the one-way valves 59 are kept closed, and the gas does not flow from the combustion chamber 29 to the scavenging ports 55 through the exhaust gas recirculation passages 58. Thereafter, as the piston 23 further moves upward, the exhaust valve 32 driven by the cam 47 closes the exhaust port 31, and the air-fuel mixture in the combustion chamber 29 is compressed by the upward movement of the piston 23. At the same time, the pressure in the crank chamber 2A is reduced, whereby the fresh air is introduced through the reed valves 54.

In this way, the engine E performs a two-cycle operation. The flow of scavenging gas and exhaust gas from the scavenging ports 55 to the exhaust port 31 via the cylinder 22 is realized as a uni-flow guided along a relatively straight path.

In the following, a description will be made of the effects of the engine E according to the present embodiment. In the engine E, when the piston 23 moves downward following the combustion, the exhaust gas recirculation passages 58 are opened by the piston 23 before the scavenging ports 55 are opened by the piston 23, such that the combustion gas in the combustion chamber 29 flows to the scavenging ports 55 through the exhaust gas recirculation passages 58. Therefore, when the scavenging ports 55 are opened by the piston 23, there is much combustion gas in the scavenging ports 55, and this combustion gas flows into the combustion chamber 29 first. Consequently, a layer of the combustion gas that had flown into the scavenging ports 55 via the exhaust gas recirculation passages 58 is created between the combustion gas in the combustion chamber 29 and the air-fuel mixture flowing into the combustion chamber 29 from the crank chamber 2A via the scavenging ports 55, whereby mixing of the air-fuel mixture flowing into the combustion chamber 29 and the combustion gas in the combustion chamber 29 is suppressed and the blow-by of the air-fuel mixture is suppressed.

Further, the amount of heat possessed by the combustion gas that flows into the scavenging ports 55 via the exhaust gas recirculation passages 58 promotes heating of the scavenging ports 55 as well as the air-fuel mixture passing through the scavenging ports 55 and also promotes evaporation of liquid fuel contained in the air-fuel mixture. Therefore, the engine E is enabled to adopt a compression ignition combustion system.

Further, since the one-way valve 59 is provided to each exhaust gas recirculation passage 58, flow of the gas into the combustion chamber 29 from the scavenging port 55 through the exhaust gas recirculation passage 58 is prevented. Consequently, the gas containing the air-fuel mixture flows into the combustion chamber 29 only from each scavenging port 55, whereby the flow becomes constant and mixing of the air-fuel mixture flowing into the combustion chamber 29 and the combustion gas in the combustion chamber 29 is suppressed. Thereby, the blow-by of the air-fuel mixture is suppressed.

Further, since each one-way valve 59 is configured to open only when the pressure in the corresponding exhaust gas recirculation passage 58 becomes greater than the pressure on the scavenging port side by a predetermined value or more, the one-way valve 59 is opened during a period in which the exhaust gas recirculation passage 58 is opened by the piston 23 and the scavenging port 55 is closed by the piston 23 while the piston 23 is moving downward, and during the other period, the one-way valve 59 is closed even if the exhaust gas recirculation passage 58 is opened by the piston 23. Thereby, the combustion gas is caused to flow into the scavenging ports 55 from the combustion chamber 29 through the exhaust gas recirculation passages 58 only during a predetermined period immediately before the scavenging ports 55 are opened.

Further, since the exhaust valve 32 is opened before the exhaust gas recirculation passages 58 are brought into communication with the combustion chamber 29 when the piston 23 is moving downward from the top dead center, the pressure in the combustion chamber 29 is reduced by some extent when the exhaust gas recirculation passages 58 are brought into communication with the combustion chamber 29. Thereby, the amount of the combustion gas flowing to the scavenging ports 55 through the exhaust gas recirculation passages 58 is prevented from becoming excessive. If a discharge passage for the combustion gas is opened during the expansion stroke, the combustion gas which has high energy flows swiftly to the discharge passage (known as a blowdown flow of the exhaust gas). Therefore, by opening the exhaust port 31 before the exhaust gas recirculation passages 58 are opened, it is possible to release a part of the combustion gas and suppress the amount of the combustion gas flowing to the exhaust gas recirculation passages 58.

Further, since each exhaust gas recirculation passage 58 is in communication with the downstream portion 57B of the corresponding scavenging port 55, the combustion gas fills the scavenging port 55 from the downstream portion 57B thereof, pushing out the air-fuel mixture toward the crank chamber, such that a layer of the combustion gas is created in the downstream portion 57B of the scavenging port 55. Owing to the layer of the combustion gas created in the scavenging port 55, mixing of the air-fuel mixture flowing into the combustion chamber 29 and the combustion gas in the combustion chamber 29 is suppressed and the blow-by of the air-fuel mixture is suppressed.

The downstream portion 57B extends along the circumferential direction on a radially outer side of the cylinder sleeve 19, and thus, it is possible to ensure an adequate length of the downstream portion 57B without increasing the size of the engine main body 1 including the crankcase 2. Further, owing to the downstream portion 57B extending in the circumferential direction, the air-fuel mixture flowing through the downstream portion 57B is given a circumferential velocity component about the cylinder axis A, and passes through the scavenging orifice 56 in the tangential direction of the cylinder 22. Thereby, the air-fuel mixture forms a swirl flow inside the cylinder 22. As the air-fuel mixture flowing in the cylinder 22 forms a swirl flow instead of flowing straight upward, mixing of the air-fuel mixture layer with the combustion gas layer is suppressed and the boundary therebetween can be maintained more clearly.

Further, since the downstream portion 57B of each scavenging port 55 is configured to slope downward toward the downstream side in each of the circumferential and radial directions with the cylinder axis being the center, the flow of gas flowing into the combustion chamber 29 from each scavenging port 55 flows in a direction away from the exhaust port 31 at an initial stage at which the flow of gas has a high velocity, and impinges upon the top of the piston 23 and the inner wall of the cylinder 22, whereby the velocity is reduced. Thereafter, the flow of gas changes its direction to flow toward the exhaust port 31. Thereby, mixing of the flow of gas flowing into the combustion chamber 29 from the scavenging port 55 with the combustion gas in the combustion chamber 29 is suppressed, and the flow of gas from the scavenging ports 55 is restrained from reaching the exhaust port 31 earlier than the combustion gas. This ensures a clear boundary between the layer of the combustion gas and the layer of the gas supplied from the scavenging ports 55 inside the combustion chamber 29, and makes it possible to discharge the combustion gas more reliably while restraining the air-fuel mixture supplied from the scavenging ports 55 from flowing out though the exhaust port 31 more reliably.

A description of the concrete embodiments has been provided in the foregoing, but the present invention is not limited to the above embodiments and various alterations and modifications are possible. For example, the number and shape of the exhaust gas recirculation passages 58 may be changed as appropriate. For example, configure may be made such the upper wall of the downstream portion 57B of each scavenging port 55 is placed at the same height as the upper edge of the scavenging orifices 56 and that each exhaust gas recirculation passage 58 has a through-hole formed in the cylinder sleeve 19 and a passage portion formed in the crankcase 2 to extend from the through-hole to the downstream portion 57B. Further, though the above embodiment includes a pair of scavenging ports 55 each provided with a corresponding exhaust gas recirculation passage 58, the number and arrangement of the scavenging ports 55 and the exhaust gas recirculation passages 58 may be changed arbitrarily.

The invention claimed is:

1. A uniflow two-stroke engine, comprising:

a cylinder receiving a piston such that the piston can reciprocate therein and defining a combustion chamber above the piston;

an exhaust port having one end in communication with an upper end portion of the cylinder;

an exhaust valve that opens and closes the exhaust port;

a scavenging port having a scavenging orifice at one end, the scavenging orifice being in communication with a lower part of a side portion of the cylinder such that the scavenging port is selectively brought into communication with and shut off from the combustion chamber by the piston;

an exhaust gas recirculation passage having one end in communication with a part of the side portion of the cylinder above the scavenging orifice and the other end in communication with the scavenging port such that the exhaust gas recirculation passage is selectively brought into communication with and shut off from the combustion chamber by the piston; and a one-way valve provided to the exhaust gas recirculation passage and permitting a flow of gas from the combustion chamber toward the scavenging port via the exhaust gas recirculation passage while preventing a flow of gas in the opposite direction, wherein the scavenging port has a downstream portion extending along the circumferential direction on a radially outer side of a cylinder sleeve forming the cylinder, wherein the exhaust gas recirculation passage extends through the cylinder sleeve in the radial direction and connects the scavenging port with the inside of the cylinder sleeve, and wherein the one-way valve consists of a reed valve mounted to an outer circumferential surface of the cylinder sleeve.

2. The uniflow two-stroke engine according to claim 1, wherein the one-way valve is configured to open only when a pressure on a side of the combustion chamber becomes greater than a pressure on a side of the scavenging port by a predetermined value or more, and opens during a period in which the exhaust gas recirculation passage is opened by the piston and the scavenging port is closed by the piston while the piston is moving downward.

3. The uniflow two-stroke engine according to claim 2, wherein the one-way valve is configured to close when the exhaust port and the scavenging port are opened during a downward stroke of the piston and is kept closed while the piston undergoes the upward stroke.

4. The uniflow two-stroke engine according to claim 1, wherein the exhaust valve is configured to open before the exhaust gas recirculation passage and the combustion chamber are brought into communication during a downward stroke of the piston.

5. The uniflow two-stroke engine according to claim 1, wherein the scavenging port has an upstream end in communication with a crank chamber defined below the cylinder and includes an upstream portion extending from the crank chamber upward along an axis of the cylinder.

6. The uniflow two-stroke engine according to claim 5, wherein the downstream portion of the scavenging port is configured to include a portion that slopes downward toward a downstream side such that a flow of gas flowing into the cylinder from the scavenging port flows in a direction away from the exhaust port.

7. The uniflow two-stroke engine according to claim 1, wherein combustion is initiated by compression ignition.

* * * * *